US011498088B2

(12) United States Patent
Saito et al.

(10) Patent No.: US 11,498,088 B2
(45) Date of Patent: Nov. 15, 2022

(54) WORK MACHINE

(71) Applicant: HONDA MOTOR CO., LTD., Tokyo (JP)

(72) Inventors: Ryo Saito, Wako (JP); Noboru Kawaguchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/492,247

(22) Filed: Oct. 1, 2021

(65) Prior Publication Data

US 2022/0016657 A1 Jan. 20, 2022

Related U.S. Application Data

(63) Continuation of application No. PCT/JP2020/021485, filed on May 29, 2020.

(51) Int. Cl.

| | |
|---|---|
| ***B05B 7/00*** | (2006.01) |
| ***B05B 11/00*** | (2006.01) |
| ***F01M 5/00*** | (2006.01) |
| *F01P 3/00* | (2006.01) |

(52) U.S. Cl.

CPC ..... *B05B 11/0002* (2013.01); *F01M 5/002* (2013.01); *F01P 2003/006* (2013.01)

(58) Field of Classification Search

CPC ..... B05B 11/0002; B05B 9/002; B08B 3/026; B08B 3/028; B08B 3/10; F01M 5/002; F01P 2003/006

See application file for complete search history.

(56) References Cited

U.S. PATENT DOCUMENTS

| | | | | |
|---|---|---|---|---|
| 6,869,324 | B2 | 3/2005 | Matsuda | |
| 2003/0148679 | A1 | 8/2003 | Matsuda | |
| 2007/0262180 | A1* | 11/2007 | Adams | B08B 3/026 239/738 |
| 2011/0081261 | A1* | 4/2011 | Klika | B05B 9/002 417/364 |
| 2015/0361839 | A1 | 12/2015 | Kimura et al. | |
| 2016/0221044 | A1* | 8/2016 | Linton | B05B 9/002 |
| 2019/0160497 | A1* | 5/2019 | Sanger | B08B 3/026 |

FOREIGN PATENT DOCUMENTS

| | | | |
|---|---|---|---|
| JP | H08-200031 | A | 8/1996 |
| JP | H09-191810 | A | 7/1997 |
| JP | H10-073013 | A | 3/1998 |

(Continued)

OTHER PUBLICATIONS

International Search Report and Written Opinion for PCT/JP2020/021485 dated Aug. 18, 2020.

*Primary Examiner* — Syed O Hasan

(74) *Attorney, Agent, or Firm* — Thomas | Horstemeyer, LLP

(57) ABSTRACT

A work machine in which an engine and a reserving unit configured to reserve lubricating oil to be supplied to the engine are connected by a lubricating oil channel, and the lubricating oil is circulated, wherein at least a part of the lubricating oil channel and at least a part of a working fluid channel for a working fluid to be supplied to a work unit of the work machine are arranged such that heat can be exchanged between the lubricating oil and the working fluid.

8 Claims, 7 Drawing Sheets

(56) References Cited

FOREIGN PATENT DOCUMENTS

| | | | |
|---|---|---|---|
| JP | H11-118370 | A | 4/1999 |
| JP | 2002-242676 | A | 8/2002 |
| JP | 2006-307865 | A | 11/2006 |
| JP | 2014-007121 | A | 1/2014 |
| JP | 2016-000963 | A | 1/2016 |
| JP | 2017-150355 | A | 8/2017 |
| JP | 2018-003685 | A | 1/2018 |
| WO | 2013/115251 | A1 | 8/2013 |

* cited by examiner

WORK MACHINE

CROSS-REFERENCE TO RELATED APPLICATION(S)

This application is a continuation of International Patent Application No. PCT/JP2020/021485 filed on May 29, 2020, the entire disclosure of which is incorporated herein by reference.

BACKGROUND OF THE INVENTION

Field of the Invention

The present invention relates to a work machine.

Description of the Related Art

PTL 1 discloses an engine oil circulation control apparatus. More specifically, there is disclosed a configuration in which, in an engine mounted in an automobile or the like, the other end of a hydraulic pipe 3 connected to an oil tank 1 is connected to a suction port 5*a* of an oil pump 5, and sucked lubricating oil is ejected from a discharge port 5*b* to a piston, a crankshaft 36, and the like via an oil supply passage.

Also disclosed is providing an oil cooler 11 configured to cool the lubricating oil to an appropriate temperature when it is heated by the piston and the like and becomes hot. More specifically, a switching valve is controlled to make an inlet 10*a* for the lubricating oil communicate with an outlet 10*c* to the oil cooler and also block the inlet 10*a* from the oil cooler and an outlet 10*b* for the lubricating oil.

CITATION LIST

Patent Literature

PTL 1: Japanese Patent Laid-Open No. H8-200031

The technique described in PTL 1 shows using engine cooling water as the heat medium of the oil cooler 11. However, to quickly cool the lubricating oil to an appropriate temperature using the cooling water of the engine that becomes hot, a large amount of cooling water needs to be ensured, and there is room for improvement.

The present invention provides a technique for efficiently cooling lubricating oil for an engine.

SUMMARY OF THE INVENTION

According to one aspect of the present invention, there is provided a work machine in which an engine and a reserving unit configured to reserve lubricating oil to be supplied to the engine are connected by a lubricating oil channel, and the lubricating oil is circulated, wherein at least a part of the lubricating oil channel and at least a part of a working fluid channel for a working fluid to be supplied to a work unit of the work machine are arranged such that heat can be exchanged between the lubricating oil and the working fluid.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain principles of the invention.

DESCRIPTION OF THE EMBODIMENTS

Figure 1:
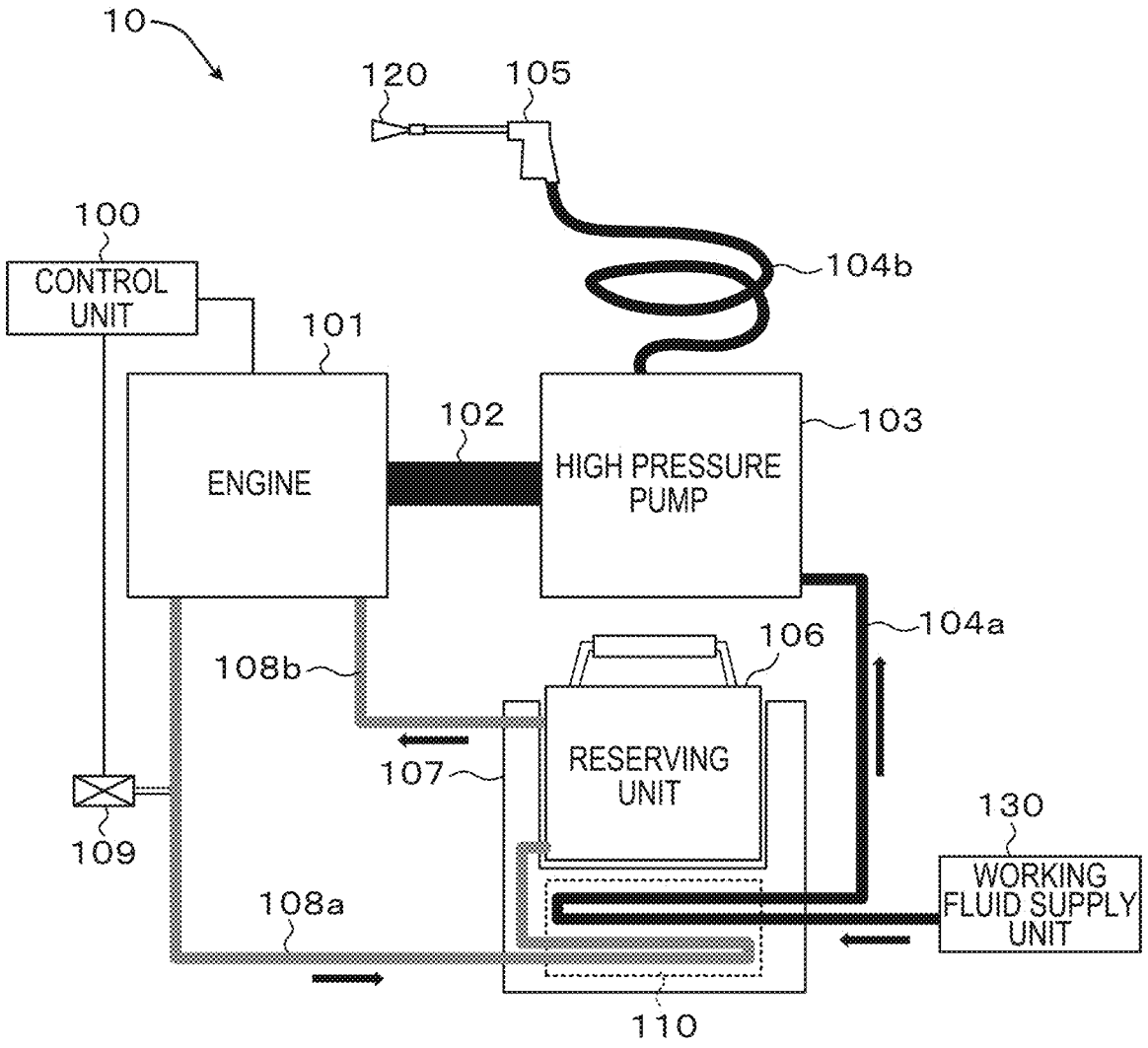
FIG. 1 is a view showing an example of the configuration of a work machine according to the first embodiment.

Hereinafter, embodiments will be described in detail with reference to the attached drawings. Note, the following embodiments are not intended to limit the scope of the claimed invention, and limitation is not made to an invention that requires a combination of all features described in the embodiments. Two or more of the multiple features described in the embodiments may be combined as appropriate. Furthermore, the same reference numerals are given to the same or similar configurations, and redundant description thereof is omitted.

First Embodiment

Configuration of Work Machine 1

FIG. 1 is a view for explaining the configuration of a work machine according to the first embodiment. Referring to FIG. 1, reference numeral 10 denotes a work machine. The work machine 10 according to this embodiment is, for example, a high pressure washing machine. The work machine 10 includes a control unit 100, an engine 101, an output shaft 102, a high pressure pump 103, working fluid channels 104*a* and 104*b*, a work unit 105, a reserving unit 106, a support unit 107, lubricating oil channels 108*a* and 108*b*, and a solenoid valve 109.

The control unit 100 is, for example, a CPU, and is connected to the engine 101 and the solenoid valve 109. The control unit 100 reads out a computer program stored in a memory (not shown) and executes it, thereby controlling the operations of these constituent elements. The engine 101 is connected to the high pressure pump 103 via the output shaft 102 and supplies a driving force to the high pressure pump 103.

The engine 101 is connected, via the lubricating oil channels 108*a* and 108*b*, to the reserving unit 106 that reserves engine oil (lubricating oil) to be supplied to the engine 101, and the lubricating oil can be circulated between the engine 101 and the reserving unit 106.

The reserving unit 106 can reserve engine oil (lubricating oil). The reserving unit 106 is supported by the support unit 107. Note that the reserving unit 106 may be an oil cartridge attachable/detachable to/from the support unit 107.

The lubricating oil flowing out of the engine 101 flows into the support unit 107 via the lubricating oil channel 108*a*. As shown in FIG. 1, at least a part of the lubricating oil channel 108*a* is arranged in the support unit 107 and connected to the reserving unit 106 via the support unit 107. The lubricating oil reserved in the reserving unit 106 flows into the engine 101 via the lubricating oil channel 108*b*. The solenoid valve 109 can control the flow in the lubricating oil channel 108*a* under the control of the control unit 100, and this can control the circulation of the lubricating oil.

On the other hand, reference numeral 120 denotes a working fluid, which is water in this embodiment. Reference numeral 130 denotes a working fluid supply unit, which is, for example, a home water supply. The working fluid 120 supplied from the working fluid supply unit 130 flows into the high pressure pump 103 via the working fluid channel 104*a*. As shown in FIG. 1, at least a part of the working fluid channel 104*a* is arranged in the support unit 107 and connected to the high pressure pump 103 via the support unit 107. The working fluid 120 then undergoes high pressure processing by the high pressure pump 103 and is guided to the work unit 105 via the working fluid channel 104*b*. An operator operates the work unit 105 and blows the working fluid 120 against a target, thereby performing a work. Here, the work unit 105 is, for example, an operation unit configured to perform high pressure washing using the working fluid 120.

As shown in FIG. 1, in the work machine 10 according to this embodiment, at least a part of the lubricating oil channel 108*a* and at least a part of the working fluid channel 104*a* are arranged to exchange heat between the lubricating oil and the working fluid 120, and a heat exchange unit 110 is thus formed.

Hence, when a new working fluid (heat medium) is always supplied to the heat exchange unit 110 in the support unit 107, the lubricating oil in the lubricating oil channel 108*a* can efficiently be cooled. In addition, the apparatus configuration can be simplified by using the working fluid channel used for a work.

Configuration of Lower Portion of Support Unit

An example of the arrangement configuration of a part of the lubricating oil channel 108*a* and a part of the working fluid channel 104*a* in the support unit 107 will be described next with reference to FIGS. 2A and 2B.

Figure 2A:
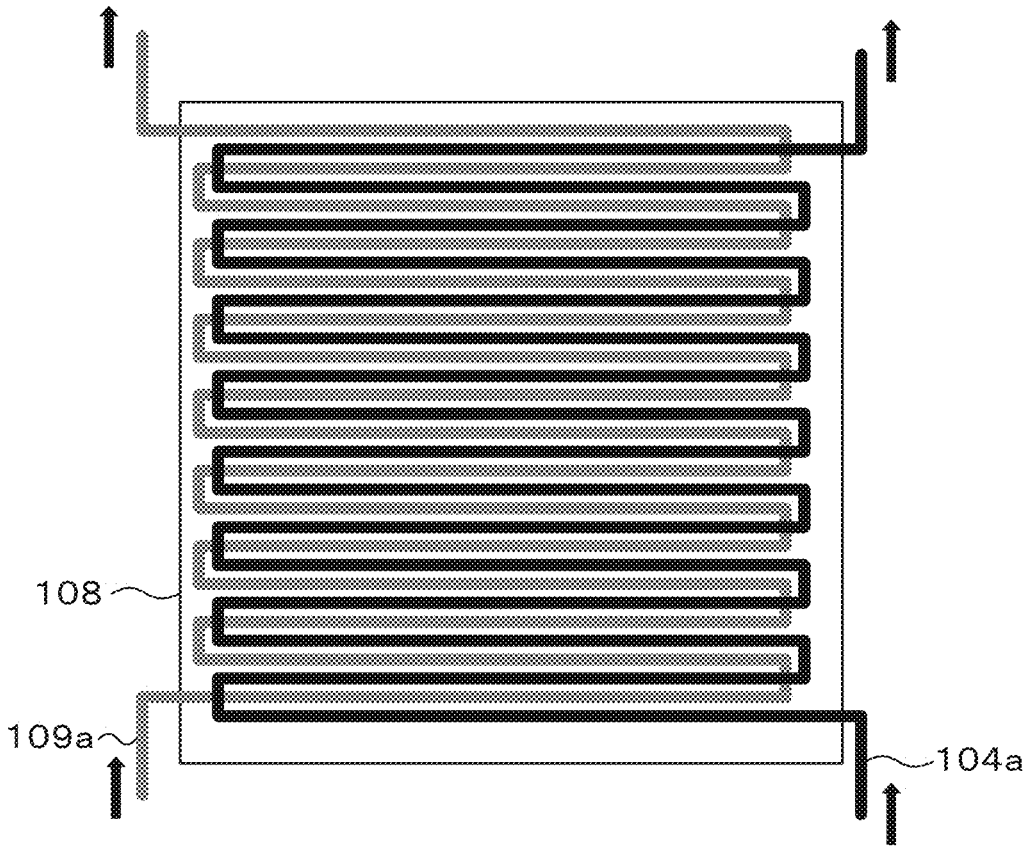
FIG. 2A is a view showing an example of the arrangement (planar view) of a lubricating oil channel and a working fluid channel according to the first embodiment.

FIG. 2A shows an example of the lubricating oil channel 108*a* and the working fluid channel 104*a* arranged in the support unit 107 in a planar view of the reserving unit 106 and the support unit 107 shown in FIG. 1 viewed vertically from above. On the other hand, FIG. 2B shows an example of a part of the lubricating oil channel 108*a* and a part of the working fluid channel 104*a* arranged in the support unit 107 in a side view of the reserving unit 106 and the support unit 107 shown in FIG. 1.

Figure 2B:
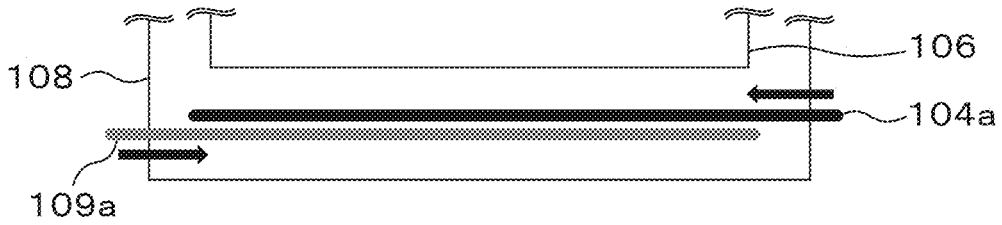
FIG. 2B is a view showing an example of the arrangement (side view) of the lubricating oil channel and the working fluid channel according to the first embodiment.

As shown in FIGS. 2A and 2B, in the support unit 107, a part of the lubricating oil channel 108*a* is arranged planarly while folding back a plurality of times so that a first plane is formed. A part of the working fluid channel 104*a* is also similarly arranged planarly while folding back a plurality of times so that a second plane is formed. Hence, the first plane and the second plane are arranged adjacently in parallel. According to this arrangement configuration, since the length in which the planarly arranged working fluid channel 104*a* and the planarly arranged lubricating oil channel 108*a* are arranged in parallel to be adjacent to each other can be increased, the heat exchange efficiency can further be improved. Also, since the internal space of the support unit 107 that supports the reserving unit 106 can be used, the lubricating oil (engine oil) can efficiently be cooled without making the work machine bulky.

Additionally, according to the arrangement example shown in FIGS. 2A and 2B, the second plane formed by the working fluid channel 104*a* is arranged close to (vertically above) the reserving unit 106, as compared to the first plane formed by the lubricating oil channel 108*a*. Since this can shorten the distance between the working fluid channel 104*a* and the reserving unit 106, heat exchange between the lubricating oil reserved in the reserving unit 106 and the working fluid 120 in the working fluid channel 104*a* can be more efficiently performed. It is therefore possible to further improve the cooling efficiency of the lubricating oil (engine oil).

As described above, in the work machine according to this embodiment, at least a part of the lubricating oil channel and at least a part of the working fluid channel are arranged to exchange heat between the lubricating oil and the working fluid. Hence, when a new working fluid (a heat medium such as water) is always supplied, the lubricating oil in the lubricating oil channel can efficiently be cooled.

Second Embodiment

Configuration of Work Machine

Figure 3:
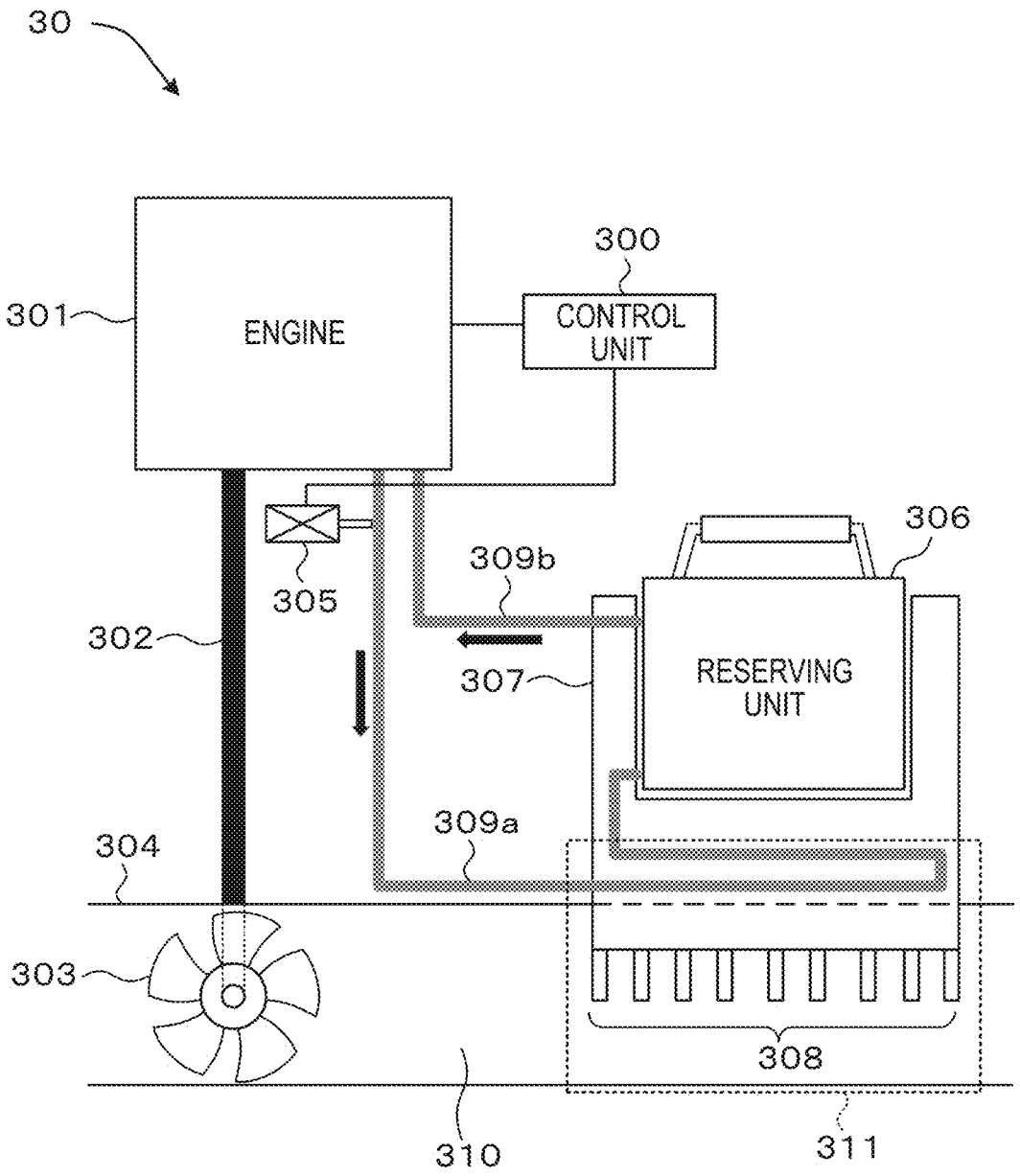
FIG. 3 is a view showing an example of the configuration of a work machine according to the second embodiment.

FIG. 3 is a view for explaining the configuration of a work machine according to the second embodiment. Referring to FIG. 3, reference numeral 30 denotes a work machine. The work machine 30 according to this embodiment is, for example, a blower vacuum used to clean fallen leaves or a riding type lawn mower capable of blowing mowed pieces of grass into a grass bag and storing those.

The work machine 30 includes a control unit 300, an engine 301, an output shaft 302, a blower unit 303, a working fluid channel 304, a solenoid valve 305, a reserving unit 306, a support unit 307, a heat dissipation fin 308, and lubricating oil channels 309*a* and 309*b*.

The control unit 300 is, for example, a CPU, and is connected to the engine 301 and the solenoid valve 305. The control unit 300 reads out a computer program stored in a memory (not shown) and executes it, thereby controlling the operations of these constituent elements. The engine 301 is connected to the blower unit 303 via the output shaft 302 and supplies a driving force to the blower unit 303.

A working fluid 310 (for example, air) blown by the blower unit 303 flows through the working fluid channel 304.

The engine 301 is connected, via the lubricating oil channels 309*a* and 309*b*, to the reserving unit 306 that reserves engine oil (lubricating oil) to be supplied to the engine 301, and the lubricating oil can be circulated between the engine 301 and the reserving unit 306. The solenoid valve 305 can control the flow in the lubricating oil channel 309*a* under the control of the control unit 300, and this can control the circulation of the lubricating oil.

The reserving unit 306 can reserve engine oil (lubricating oil). The reserving unit 306 is supported by the support unit 307. Note that the reserving unit 306 may be an oil cartridge attachable/detachable to/from the support unit 307. The support unit 307 includes the heat dissipation fin 308, and the heat dissipation fin 308 are formed to project into the working fluid channel 304. Via the heat dissipation fin 308, heat can be exchanged between the lubricating oil flowing in the lubricating oil channel 309*a* and the working fluid 310 flowing in the working fluid channel 304. A heat exchange unit 311 is thus formed. Hence, when a new working fluid (heat medium) is always supplied to the heat exchange unit 311, the lubricating oil in the lubricating oil channel 309*a* can efficiently be cooled. In addition, the apparatus configuration can be simplified by using the working fluid channel used for a work.

Note that as in the example shown in FIGS. 2A and 2B of the first embodiment, at least a part of the lubricating oil channel 309*a* may be arranged planarly while folding back a plurality of times so that a plane is formed. Since this makes many parts of the lubricating oil channel 309*a* close to the working fluid channel 304, the efficiency of heat exchange between the lubricating oil and the working fluid 310 can be further improved.

As described above, in the work machine according to this embodiment, at least a part of the lubricating oil channel and at least a part of the working fluid channel are arranged to exchange heat between the lubricating oil and the working fluid. Hence, when a new working fluid (a heat medium such as air) is always supplied, the lubricating oil in the lubricating oil channel can efficiently be cooled.

Third Embodiment

Configuration of Work Machine

Figure 4:
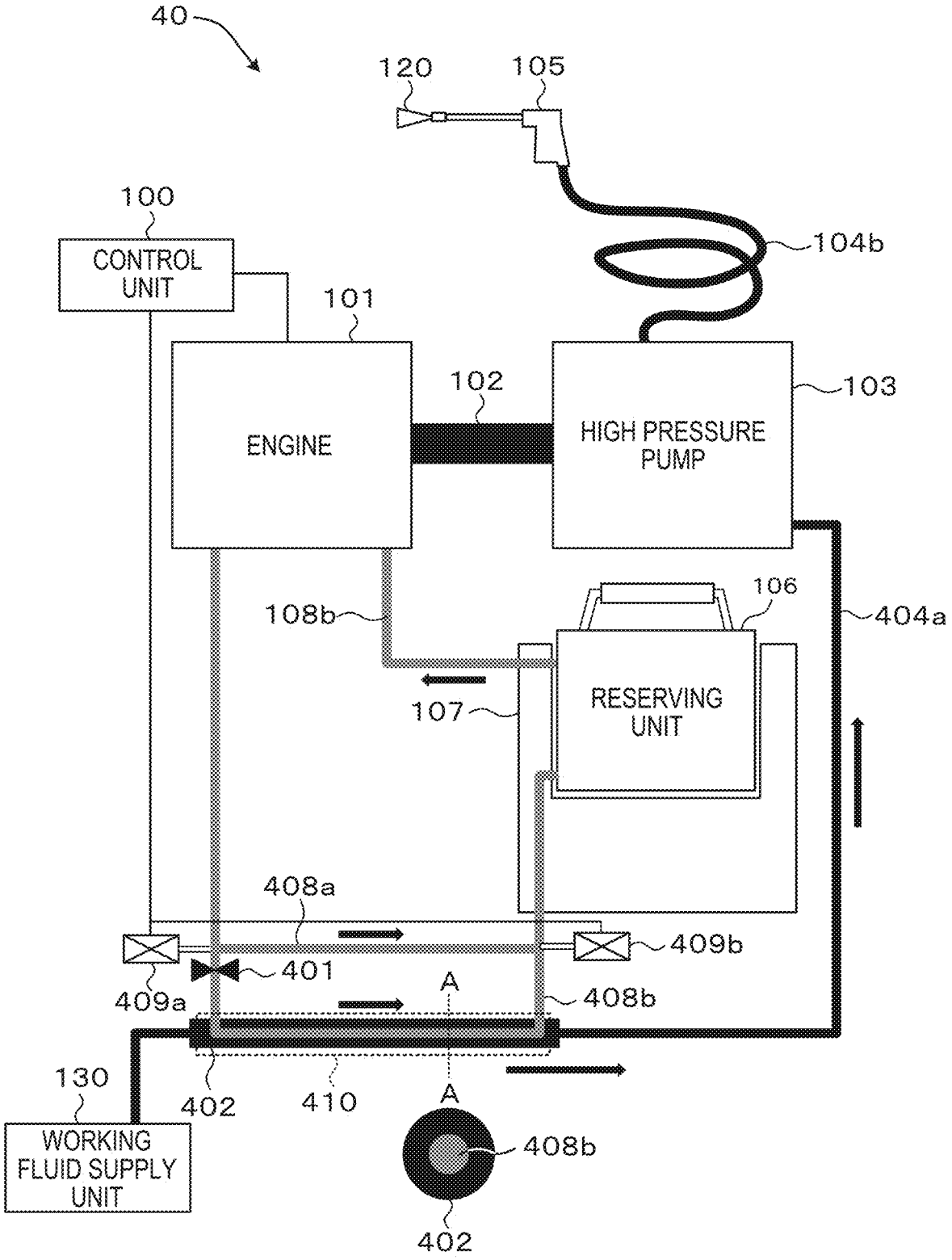
FIG. 4 is a view showing an example of the configuration of a work machine according to the third embodiment.

FIG. 4 is a view for explaining the configuration of a work machine according to the third embodiment. Referring to FIG. 4, reference numeral 40 denotes a work machine. The work machine 40 according to this embodiment is, for example, a high pressure washing machine. The same reference numerals as those of the above-described constituent elements denote the same constituent elements in FIG. 4, and a detailed description thereof will be omitted.

In this embodiment, a working fluid channel 404*a* is provided in place of the working fluid channel 104*a* described with reference to FIG. 1. In addition, a working fluid channel 402 is arranged in a part of the working fluid channel 404*a*. A working fluid (for example, water) supplied from a working fluid supply unit 130 flows into a high pressure pump via the working fluid channel 404*a*.

Also, in this embodiment, a lubricating oil channel 408*a* and a lubricating oil channel 408*b* are provided in place of the lubricating oil channel 108*a* described with reference to FIG. 1, and a solenoid valve 409*a* and a solenoid valve 409*b* are provided in place of the solenoid valve 109. Engine oil (lubricating oil) flows from an engine 101 to a reserving unit 106 via the lubricating oil channel 408*a* or the lubricating oil channel 408*b* in accordance with switching by the solenoid valve 409*a* and the solenoid valve 409*b*.

Opening/closing of the solenoid valve 409*a* and the solenoid valve 409*b* is controlled under the control of a control unit 100. The control unit 100 controls the solenoid valve 409*a* and the solenoid valve 409*b* based on the temperature of the lubricating oil detected by a temperature sensor 401. For example, if the temperature detected by the temperature sensor 401 has a predetermined value or more, the lubricating oil needs to be cooled. Hence, the solenoid valve 409*a* and the solenoid valve 409*b* are controlled to make a change such that the lubricating oil passes through the lubricating oil channel 408*b*. On the other hand, if the temperature is less than the predetermined value, the lubricating oil need not be cooled. Hence, the solenoid valve 409*a* and the solenoid valve 409*b* are controlled to make a change such that the lubricating oil passes through the lubricating oil channel 408*a*.

In this embodiment, a part of the lubricating oil channel 408*b* is covered to be included in the working fluid channel 402. A double-tube structure is formed, as indicated by a section taken along a line A-A. When a heat exchange unit 410 is formed in this way, the cooling efficiency of the lubricating oil can be improved.

Figure 5:
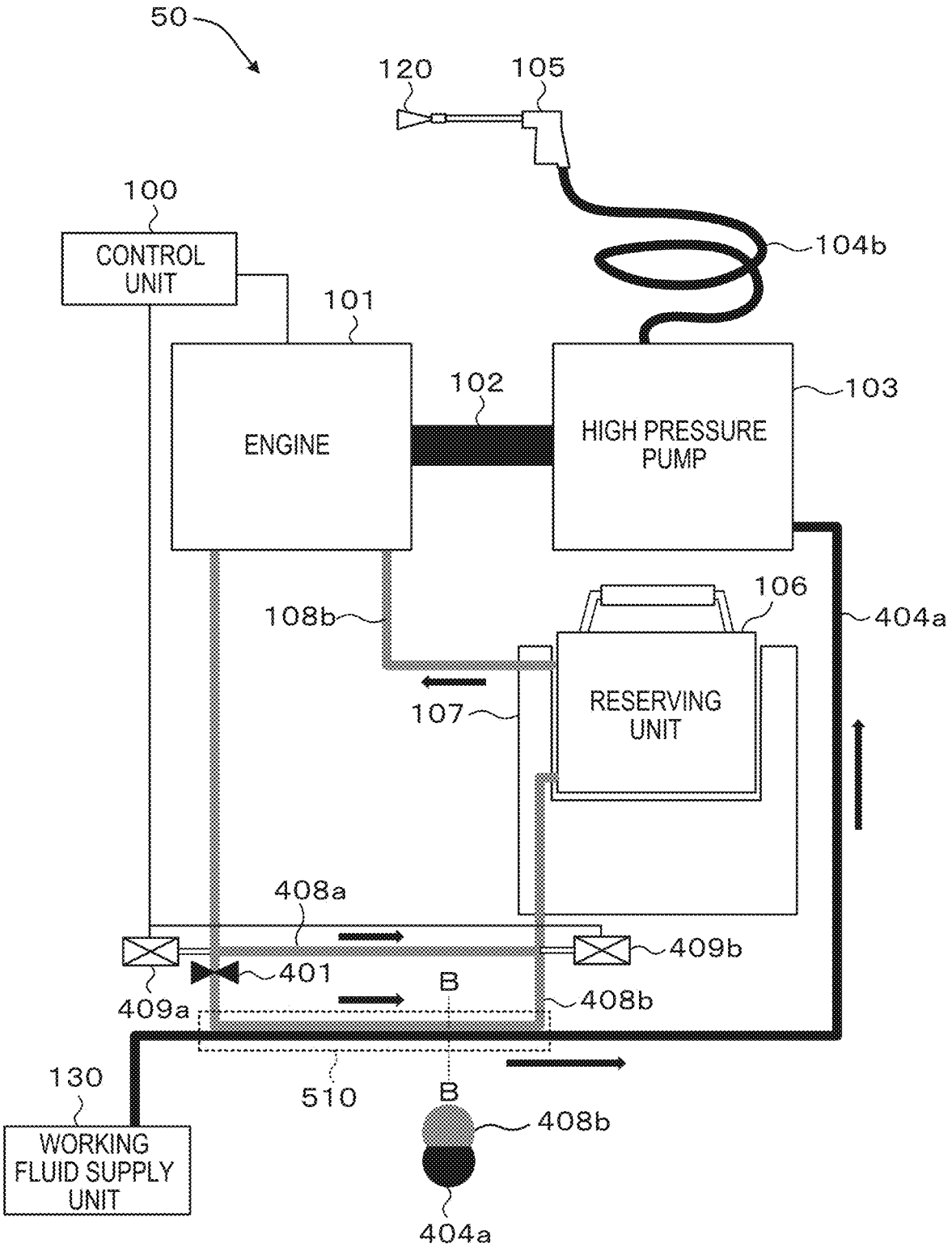
FIG. 5 is a view showing an example of the configuration of a work machine according to a modification of the third embodiment.

FIG. 5 is a view for explaining the configuration of a work machine according to a modification of the third embodiment. Referring to FIG. 5, reference numeral 50 denotes a work machine. The work machine 50 according to this embodiment is, for example, a high pressure washing machine. The same reference numerals as those of the above-described constituent elements denote the same constituent elements in FIG. 5, and a detailed description thereof will be omitted.

The work machine 50 has almost the same configuration as the work machine 40 described with reference to FIG. 4. In this embodiment, a part of the lubricating oil channel 408*b* is arranged to be adhered to the working fluid channel 402. For example, these can be adhered by, for example, brazing. By the adhering, a contact structure is formed, as indicated by a section taken along a line B-B. When a heat exchange unit 510 is formed in this way, the cooling efficiency of the lubricating oil can be improved.

Fourth Embodiment

Figure 6:
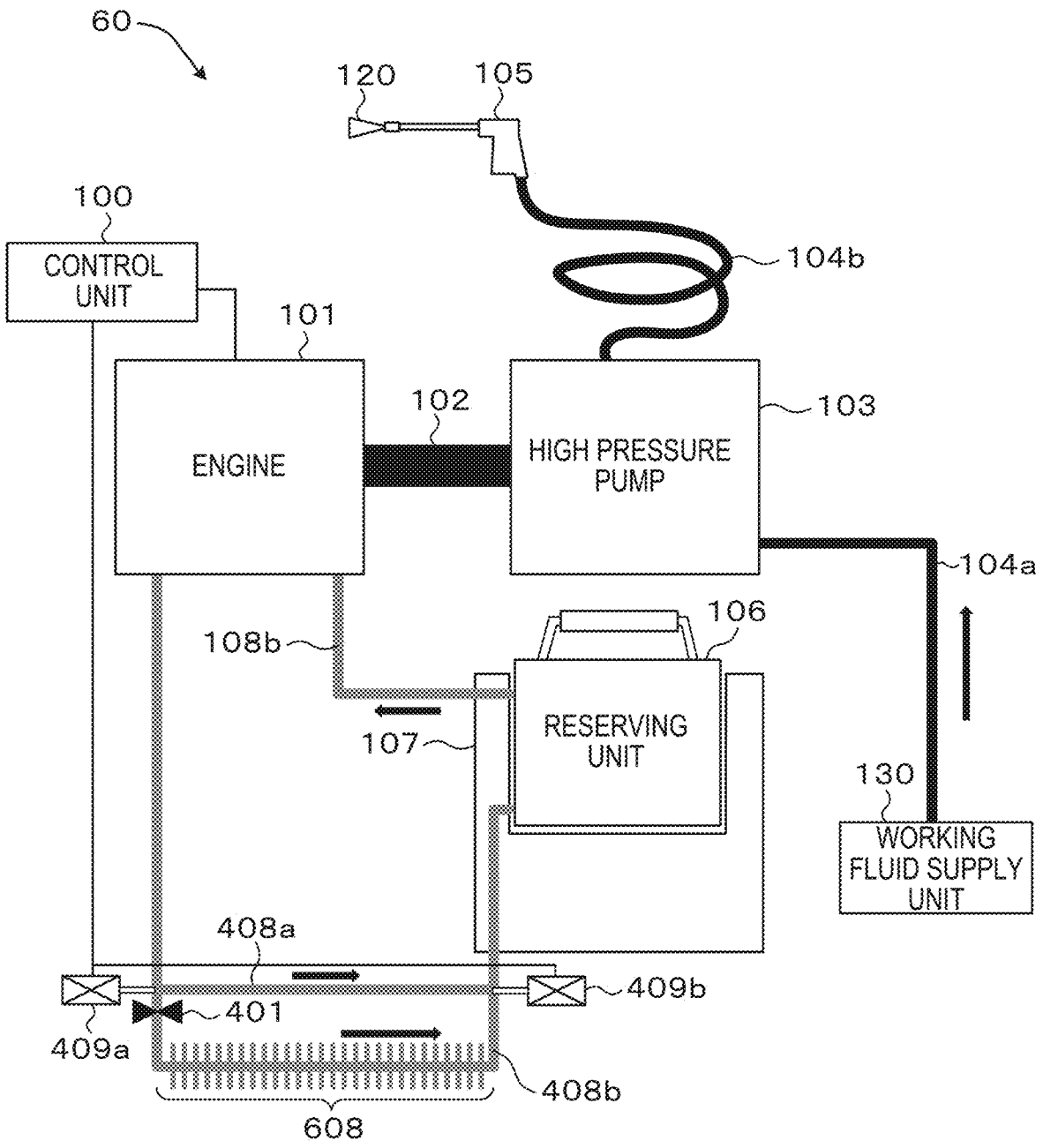
FIG. 6 is a view showing an example of the configuration of a work machine according to the fourth embodiment.

FIG. 6 is a view for explaining the configuration of a work machine according to the fourth embodiment. Referring to FIG. 6, reference numeral 60 denotes a work machine. The work machine 60 according to this embodiment is, for example, a high pressure washing machine, but may be a blower vacuum or a riding type lawn mower described in the second embodiment with reference to FIG. 3. The same reference numerals as those of the above-described constituent elements denote the same constituent elements in FIG. 6, and a detailed description thereof will be omitted.

In the work machine 60, engine oil (lubricating oil) flows from an engine 101 to a reserving unit 106 via a lubricating oil channel 408*a* or a lubricating oil channel 408*b* in accordance with switching by a solenoid valve 409*a* and a solenoid valve 409*b*, as in the configurations described with reference to FIGS. 4 and 5.

Here, since the lubricating oil channel 408*b* includes a heat dissipation fin 608, heat can efficiently be exchanged between outside air and the lubricating oil in the lubricating oil channel 408*b*. It is therefore possible to improve the cooling efficiency of the lubricating oil. Since the portion of the heat dissipation fin 608 can freely be located at a position where air flows, this configuration can readily be applied to work machines of various structures. Also, if the work machine according to this embodiment is a blower vacuum or a riding type lawn mower described in the second embodiment, the lubricating oil channel 408*b* and the heat dissipation fin 608 may be arranged to project into the channel where the working fluid (a heat medium such as air) flows. This allows the lubricating oil to exchange heat not only with outside air but also with the working fluid (air).

Note that even in the double-tube structure or the contact structure described in the third embodiment, when a heat dissipation fin is provided inside or outside the tube, or an uneven shape is formed, more efficient heat exchange can be implemented. This can further improve the cooling efficiency of the lubricating oil.

MODIFICATIONS

Note that in the above-described embodiments, several examples in which the lubricating oil channel and the working fluid channel are arranged such that heat can be exchanged between the lubricating oil and the working fluid have been described. However, the manner in which the arrangement configuration is implemented is not limited to the shown examples. What is only needed is to make at least parts of the channels close to each other, and it is not essential that the channels are parallel to each other.

Additionally, in the configurations of the work machines described in the above embodiments, not all the constituent elements are indispensable. Some constituent elements may not be included, and another constituent element may be added.

As examples of the work machine, a high pressure washing machine has been described as an example of water cooling, and a blower vacuum and a riding type lawn mower have been described as examples of air cooling. However, work machines to which the present invention is applicable are not limited to these examples, and the present invention can be applied to various other work machines as well.

Summary of Embodiments

A work machine (for example, 10, 30) according to the first aspect is a work machine in which an engine (for example, 101, 301) and a reserving unit (for example, 106, 306) configured to reserve lubricating oil are connected by a lubricating oil channel (for example, 108*a*, 108*b*, 309*a*, 309*b*), and the lubricating oil to be supplied to the engine is circulated, wherein at least a part of the lubricating oil channel and at least a part of a working fluid channel (104*a*, 104*b*, 304) for a working fluid (for example, 120, 310) to be supplied to a work unit (for example, 105) of the work machine are arranged such that heat can be exchanged between the lubricating oil and the working fluid.

Accordingly, a fluid (heat medium) used in a work is always newly supplied, thereby increasing the cooling efficiency of the lubricating oil in the lubricating oil channel. Also, when the channel of the fluid used in a work is used, the apparatus can be simplified.

In the work machine according to the second aspect, the work machine comprises a support unit (for example, 107, 307) configured to support the reserving unit, wherein at least the part of the lubricating oil channel is arranged in the support unit.

Accordingly, heat can be exchanged between the lubricating oil and the working fluid without extending the lubricating oil channel connected to the reserving unit more than needed.

In the work machine according to the third aspect, at least the part of the working fluid channel is arranged in the support unit, and at least the part of the lubricating oil channel and at least the part of the working fluid channel are arranged close in the support unit such that heat can be exchanged between the lubricating oil and the working fluid.

When the working fluid channel is also provided in the support unit in which the lubricating oil channel is provided, the lubricating oil channel and the working fluid channel can be arranged close, and the heat exchange efficiency (cooling efficiency) can be improved.

In the work machine according to the fourth aspect, at least the part of the lubricating oil channel and at least the part of the working fluid channel are arranged adjacently in parallel in the support unit.

Since this can ensure a portion where the lubricating oil channel and the working fluid channel are close, the heat exchange efficiency (cooling efficiency) can be improved.

In the work machine according to the fifth aspect, at least the part of the lubricating oil channel is arranged planarly to form a first plane in the support unit (for example, FIG. 2A), at least the part of the working fluid channel is arranged planarly to form a second plane in the support unit (for example, FIG. 2A), and the first plane and the second plane are arranged adjacently in parallel.

Since this can ensure many portions where the lubricating oil channel and the working fluid channel are close, the heat exchange efficiency (cooling efficiency) can further be improved.

In the work machine according to the sixth aspect, the second plane is arranged close to the reserving unit as compared to the first plane (for example, FIG. 2B).

When the second plane formed by the part of the working fluid channel is arranged close to the reserving unit, not only heat exchange between the working fluid in the working fluid channel and the lubricating oil in the lubricating oil channel but also heat exchange between the working fluid in the working fluid channel and the lubricating oil reserved in the reserving unit can be performed. It is therefore possible to further improve the heat exchange efficiency.

In the work machine according to the seventh aspect, the support unit includes a heat dissipation fin (for example, 308) formed to project into the working fluid channel, and heat can be exchanged between the lubricating oil and the working fluid via the heat dissipation fin.

When the heat dissipation fin is formed to project into the working fluid channel, the heat exchange efficiency between the working fluid and (the lubricating oil in the lubricating oil channel via) the support unit can be improved.

In the work machine according to the eighth aspect, the reserving unit is attachable/detachable to/from the support unit.

This facilitates exchange of the reserving unit.

In the work machine according to the ninth aspect, at least the part of the lubricating oil channel and at least the part of the working fluid channel form a double-tube structure (for example, A-A section, 408*b*, 402) in which at least the part of the lubricating oil channel passes an inside of at least the part of the working fluid channel.

Since this can ensure a portion where the lubricating oil channel and the working fluid channel are close, the heat exchange efficiency (cooling efficiency) can be improved.

In the work machine according to the 10th aspect, at least the part of the lubricating oil channel and at least the part of the working fluid channel form a contact structure (for example, B-B section, 408*b*, 404*b*) in which the parts are in contact with each other by adhering along a channel.

Since this can ensure a portion where the lubricating oil channel and the working fluid channel are close, the heat exchange efficiency (cooling efficiency) can be improved.

In the work machine according to the 11th aspect, at least the part of the lubricating oil channel includes a heat dissipation fin (for example, 608), and heat can be exchanged between the lubricating oil and one of the working fluid and outside air via the heat dissipation fin.

This can improve the heat exchange efficiency (cooling efficiency) between the lubricating oil and the working fluid or outside air.

According to the present invention, it is possible to efficiently cool lubricating oil for an engine.

Other Embodiments

A program configured to implement one or more functions described in each embodiment is supplied to a system or an apparatus via a network or a storage medium, and one or more processors in the computer of the system or the apparatus can read out and execute the program. The present invention can be implemented by such an aspect as well.

The invention is not limited to the foregoing embodiments, and various variations/changes are possible within the spirit of the invention.

What is claimed is:

1. A work machine in which an engine and a reserving unit configured to reserve lubricating oil to be supplied to the engine are connected by a lubricating oil channel, and the lubricating oil is circulated, wherein at least a part of the lubricating oil channel and at least a part of a water channel for water to be supplied to a work unit of the work machine are arranged such that heat can be exchanged between the lubricating oil and the water; a support unit configured to support the reserving unit; wherein at least the part of the lubricating oil channel is arranged in the support unit; wherein at least the part of the water channel is arranged in the support unit; at least the part of the lubricating oil channel and at least the part of the water channel are arranged adjacent to each other in the support unit such that heat can be exchanged between the lubricating oil and the water; wherein the support unit includes a heat dissipation fin formed to project into the water channel; and heat can be exchanged between the lubricating oil and the water via the heat dissipation fin.

2. The work machine according to claim 1, wherein at least the part of the lubricating oil channel and at least the part of the water channel are arranged adjacently in parallel in the support unit.

3. The work machine according to claim 1, wherein at least the part of the lubricating oil channel is arranged planarly to form a first plane in the support unit, at least the part of the water channel is arranged planarly to form a second plane in the support unit, and the first plane and the second plane are arranged adjacently in parallel.

4. The work machine according to claim 3, wherein the second plane is arranged adjacent to the reserving unit as compared to the first plane.

5. The work machine according to claim 1, wherein the reserving unit is attachable/detachable to/from the support unit.

6. The work machine according to claim 1, wherein at least the part of the lubricating oil channel and at least the part of the water channel form a double-tube structure in which at least the part of the lubricating oil channel passes an inside of at least the part of the water channel.

7. The work machine according to claim 1, wherein at least the part of the lubricating oil channel and at least the part of the water channel form a contact structure in which the parts are in contact with each other by adhering along a channel.

8. The work machine according to claim 1, wherein at least the part of the lubricating oil channel includes a heat dissipation fin, and heat can be exchanged between the lubricating oil and one of the water and outside air via the heat dissipation fin.

* * * * *